United States Patent [19]

Gundlach et al.

[11] 4,302,094

[45] Nov. 24, 1981

[54] DEVELOPMENT METHOD AND APPARATUS

[75] Inventors: Robert W. Gundlach, Victor; Richard F. Bergen, Ontario, both of N.Y.

[73] Assignee: Xerox Corporation, Stamford, Conn.

[21] Appl. No.: 135,739

[22] Filed: Mar. 31, 1980

[51] Int. Cl.[3] ..... G03G 15/00

[52] U.S. Cl. ..... 355/3 DD; 118/653; 430/120

[58] Field of Search ..... 355/3 DD, 3 BE, 16, 355/77; 118/653, 655; 430/120, 121

[56] References Cited

U.S. PATENT DOCUMENTS

| | | | |
|---|---|---|---|
| 3,234,017 | 2/1966 | Heyl et al. | 96/1 |
| 3,519,461 | 7/1970 | Stowell | 117/17.5 |
| 4,048,921 | 9/1977 | Raschke | 101/DIG. 13 |
| 4,103,994 | 8/1978 | Bean | 355/3 R |
| 4,124,287 | 11/1978 | Bean et al. | 355/3 DD |
| 4,181,422 | 1/1980 | Forgo et al. | 355/3 DD |
| 4,185,916 | 1/1980 | Miller et al. | 355/3 DD |
| 4,240,723 | 12/1980 | Forgo | 355/3 DD |

FOREIGN PATENT DOCUMENTS

| | | | |
|---|---|---|---|
| 2025796 | 1/1980 | United Kingdom | 355/14 D |

*Primary Examiner*—Richard L. Moses

[57] ABSTRACT

In the development of xerographic images wherein the latent image is in the form of a periodic charge pattern, polar or polarizable toner particles are employed. It is desirable to utilize a development system that will bring the polar or polarizable toner into contact with the periodic charge pattern without triboelectrically charging the particles. To achieve this aim, an apparatus and method are described for moving the polar or polarizable toner particles through a development zone at substantially the same speed and in the same direction as that of the imaging member.

17 Claims, 3 Drawing Figures

DEVELOPMENT METHOD AND APPARATUS

BACKGROUND OF THE INVENTION

This invention relates to electrostatography and more particularly to an apparatus and method of developing latent image nonuniform charge patterns on an imaging member.

Xerography as originally described in U.S. Pat. No. 2,297,691 to Carlson and later related patents generally includes the steps of charging a photoconductive insulating member to sensitize it and then subjecting the photoconductive member to a light image or other pattern of activating electromagnetic radiation which serves to dissipate charge in radiation struck areas, thus leaving a charge pattern or latent electrostatic image on the photoconductor conforming to the radiation pattern. This radiation pattern is generally referred to as a uniform or a homogeneous charge pattern because there is substantially no potential gradient between small discrete areas where the charge has not been dissipated by exposure to the actinic radiation. Thus, in areas having a uniform charge thereon the lines of force lie within the photoconductive material and do not extend out from the exposed surface of the photoconductive material except at the very edge of an imaging area where a discharged portion of the photoreceptor is adjacent to a charged portion. In this area, the lines of force are present in what has been referred to as a fringe field and extend above the exposed surface of the photoconductive imaging member.

While this uniform charge pattern in unexposed areas was difficult to develop in solid dark image areas, because of the nature of the field present, various techniques were employed. One particularly satifactory technique uses a development electrode, which permits the development of the solid large areas with the customary development materials, i.e. a two component developer including a carrier material and a toner material. In these systems the toner is triboelectrically charged by contact with the carrier particles, the charge being opposite in sign to that present on the photoconductive imaging member. A disadvantage of this type of development system is commonly referred to as "the starvation effect" because as large quantities of the toner material are deposited in image configuration the ratio of the toner to the carrier present in the developer mixture changes thus requiring constant addition of toner to prevent the depletion thereof accompanied by incomplete deposition in the reproduction subsequent in time.

U.S. Pat. Nos. 3,234,017 and 3,519,461 disclose techniques whereby a nonuniform or nonhomogeneous charge pattern in image configuration is produced on an imaging surface wherein small individual, discrete surface elements adjacent to each other within the imaging area are either oppositely charged or some discrete areas are charged and the adjacent areas discharged in order establish a potential gradient between adjacent discrete areas thus permitting the development thereof by utilizing polarizable minute uncharged toner particles. These particles are polarized in the fringe fields protruding above the surface of the imaging member and are thus attracted in image configuration to the imaging member. This system will, because of its nature, develop solid areas without the necessity for development electrodes as indicated above where uniform fields and two component developers are employed. In addition, no starvation effects are present because the developer is 100 percent toner.

Unfortunately, because of the nature of this system, several disadvantages are present which create problems in the handling and development of the latent image using single component uncharged toner particles. The strength of the fringe fields employed, that is, the forces which attract and hold the toner particles in image configuration to the imaging member are not as great as those present in electrostatographic systems wherein uniform charge patterns are present on the imaging member and the particles are attracted as a result of triboelectricity. Thus, it has been found that the raking action of a brush, even a soft fiber brush or a carrierless magnetic brush formed of magnetic toner only, utilizes forces greater than present in the system for holding the toner to the imaging member. In addition, since the toner particles should remain uncharged in order that they are capable of being polarized by the fringe fields present in the nonuniform charge pattern, care must be taken to prevent charging of the toner particles by contact with materials having a different relative position in the triboelectric series. A development system is required that exerts less force on the toner particles than that due to the nonuniform charge pattern in order to prevent removal of toner from desired image portions. Also, any unwanted charging of the toner particles will produce forces stronger than the forces due to the polarization of the particles in nonuniform fields and will produce unbalanced deposition of the toner particles in both types of discrete areas present within the charged pattern as well as excessive background in non-image areas.

While the advantages relative to the development of nonuniform charge pattern appear to be meritorious, the industry has not developed in this direction most likely because of the large commercial success of electrostatographic devices employing uniform charge patterns together with dual development systems wherein development electrodes of a various nature have been employed in order to permit the development of large dark areas. One extremely useful development device where both single component developer, that is, toner alone, and dual development, that is, where a carrier and a toner are employed, is the magnetic brush. These devices are well documented in the patent literature and are currently probably the most widely used means of developing electrostatographic images. Magnetic brushes have also been employed in single component development wherein the toner contains magnetic pigments. It can thus be seen that in such magnetic brush systems either a magnetic carrier material must be present which is also triboelectrically active with respect to the toner particles involved or else the toner particles themselves must be magnetic in order to be employed with a magnetic brush device. This is a serious handicap where reproductions other than black or brown images are desired since magnetic particles included in the toner particles are extremely dark by nature and make it substantially impossible to develop images in suitable colors other than black or brown. Further, as indicated above, problems are created because of the forces inherent in the magnetic development systems.

Accordingly, it is a primary object of the present invention to provide an improved apparatus and method for developing nonuniform charge patterns on an imaging surface.

| PRIOR ART STATEMENT | | |
|---|---|---|
| INVENTORS | U.S. PATENT | ISSUE DATE |
| Heyl et al | 3,234,017 | February 8, 1966 |
| Stowell | 3,519,461 | July 7, 1970 |
| Raschke | 4,048,921 | September 20, 1977 |
| Bean | 4,103,994 | August 1, 1979 |

Heyl et al U.S. Pat. No. 3,234,017—A non-homogeneous charge pattern is produced by subjecting the photoconductive layer to an electric potential by means of a corona discharge large enough to cause the photoconductive layer to break down electrically at multiple closely spaced discrete locations and depositing uncharged toner to develop the image.

Stowell U.S. Pat. No. 3,519,461—A method of electrostatic printing is disclosed whereby electrical dipoles are established on a dielectric surface and developed with uncharged polarizable toner powder.

Raschke U.S. Pat. No. 4,048,921—An electrostatic charge pattern is established on a dielectric surface and this charge pattern is toned with an insulating fluid containing small particles of high dielectric constant which thereby obtain an induced dipole moment.

Bean U.S. Pat. No. 4,103,994—A recording member is disclosed including a photoconductive layer having embedded therein at least a pair of insulated conductive members. A potential difference is imposed across the pair of conductors to form an electrical field. The imaging member is exposed in image configuration and the latent image developed with uncharged insulating particles using a magnetic development system.

SUMMARY OF THE INVENTION

In accordance with this invention there is provided a method and apparatus for the development of nonuniform charge patterns on an imaging member with polar or polarizable toner particles wherein the imaging member containing the charge pattern in image configuration is moved into a development zone while toner particles are moved into the development zone into proximity with the charge pattern on the imaging member synchronously therewith. That is, both the speed and direction at which the imaging member moves through the development zone are synchronized with respect with the movement of toner particles through the development zone. The toner particles are moved in the form of a toner blanket having a thickness approximately equivalent to the distance between the development apparatus and the imaging member.

By moving this toner blanket, which is a very loosely packed layer of toner particles, through the development zone defined by the imaging member and the development apparatus, at substantially the same speed and in the same direction as the movement of the imaging member, very little mechanical force is exerted by the development apparatus on the toner particles which have previously engaged the voltage gradient due to the nonuniform charge pattern on the imaging member. Thus, the particles of toner within the lines of force of the nonuniform charge pattern are first polarized and then attracted to the imaging member without the subsequent removal thereof by extraneous forces greater than the forces due to the fields on the imaging member.

The imaging apparatus in accordance with this invention includes a development means which together with the imaging member defines a development zone where polar or polarizable uncharged toner particles are deposited on the nonuniform charge pattern present on the imaging member. The development means includes a toner transport means for moving the uncharged toner particles through the development zone at a rate substantially equal to the rate at which the imaging member moves therethrough. In accordance with customary electrostatographic recording apparatus the imaging member moves through a plurality of processing stations prior and subsequent to moving through the development station. The toner transport means includes a toner support member and a motion imparting means to move the toner along the toner support member into the development zone in the form of a loosely packed blanket of toner particles which will come under the influence of the lines of force of the uniform charge pattern and be attracted thereto in image configuration. It may also be desirable to include a toner pile height control means which establishes the height of the toner blanket at approximately the distance between the toner support member and the imaging member. This toner pile height control means can be any of a variety of suitable devices such as, for example, a doctor blade, a roller, a wiper blade or the like. It may also be desirable in order to maintain the loosely packed nature of the toner blanket to include a vibration means which causes the vibration of toner support member. This vibration means may also serve a dual purpose to provide motion through the development zone at the same rate as the imaging member. In this embodiment, the vibration due to the vibration means imparts a force which has two vectors, one being perpendicular to the support member while the other is parallel there, moving the particles toward and through the development zone. The toner support member may take various forms including, for example, various forms of conveyor means such as belt conveyors or bucket or paddle conveyors or the support member can be a surface inclined with respect to the horizontal wherein the toner blanket is formed thereon and moves by gravity and by the vibration imparted thereto toward and through the development zone at a rate substantially equal to the rate of the imaging member.

BRIEF DESCRIPTION OF THE DRAWINGS

Other aspects of the present invention will become apparent from the following description taken in conjunction with the accompanying drawings, in which.

Figure 1:
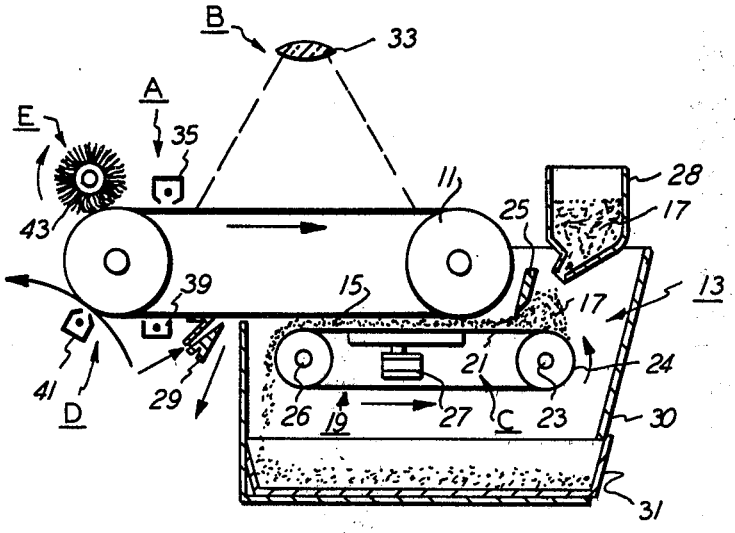
FIG. 1 is a schematic elevation of an electrostatographic device employing one embodiment of a development apparatus in accordance with this invention.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

For a general understanding of the features of the present invention, reference is made to the drawings in which, like reference characters have been used throughout to identify and designate identical or similar elements.

It will become apparent from the following discussion that the method and apparatus of this invention described hereinafter is equally well suited for use in a wide variety of electrostatographic printing machines and is not necessarily limited in its application to the particular embodiment shown herein.

Inasmuch as the art of electrostatographic printing is well known, the various processing stations employed in FIG. 1 are shown schematically and their operation described briefly with reference thereto.

Figure 2:
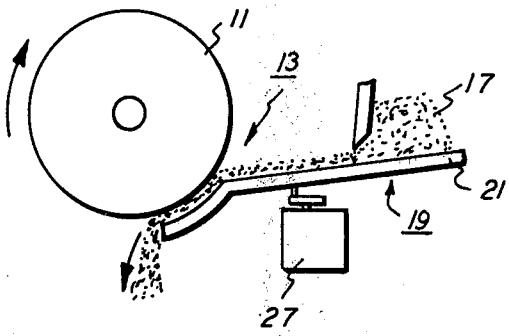
FIG. 2 is a schematic elevation of another embodiment of a development apparatus in accordance with this invention and, FIG. 3 is a schematic elevation of a third embodiment of a development apparatus in accordance with this invention.

FIG. 1 illustrates a continuous belt type imaging member 11 which moves in the direction shown by the arrows through the various processing stations disposed thereabout. The imaging member 11 while shown in the form of a continuous belt can also have the form of a cylinder as shown in FIG. 2, or any other suitable configuration known in the art. Further, the imaging member 11 may be an insulating material or a photoconductive material depending upon the manner in which the charge pattern in image configuration is imparted thereto, the essential point being that the charge pattern in image configuration be nonuniform in nature in order to establish the necessary fields to employ polar or polarizable toner particles in the development thereof. In this regard, when an insulating imaging member is employed, the nonuniform charge pattern in image configuration may be deposited thereon by use of styli or by corona charging through a screen stencil or other suitable means for imparting thereto a nonuniform periodic charge pattern. When a photoreceptive material, such as for example, selenium, alloys thereof, polyvinylcarbazole-nitrofluorenone and the like are employed, the pattern may be formed in the same manner as with respect to insulator or a suitable corona source 35, such as that shown at processing station A, can first be utilized to charge the photoreceptor over the entire surface with a periodic pattern and then the imaging member can be exposed in typical fashion through a lens system as shown at processing station B by exposure means 33. Alternatively, the corona charging device 35 may deposit a uniform charge pattern onto imaging member 11 and the exposure can be such as to create a nonuniform periodic charge pattern such as, by exposure through a screen for example. In addition, it is to be understood that any of the suitable techniques for imparting a nonuniform periodic charge pattern to an imaging member such as set forth in any of the references included in the prior art section of this application may be employed. It should therefore be understood that the method illustrated in FIG. 1 for imparting the charge pattern to the imaging member is for purposes of illustration only and that any means for imparting the nonuniform charge pattern is within the scope of this invention and that all known means are contemplated herein.

The imaging member 11 next passes through the development station C wherein the development means is shown generally as reference character 13 and includes a toner transport means 19 which is made up of toner support member 21 and motion imparting means 23. Motion imparting means 23 in the embodiment shown takes the form of a driving roll 24 and a driven roll 26 about which the toner transport means 19, shown in the form of a belt conveyor, revolves. The upper surface of the belt conveyor forms the toner support member 21. The driving roll 24 is rotated by suitable means, not shown, at a rate such that the toner particles 17 move through the development zone 15 at a rate substantially equivalent to the rate that the imaging member 11 moves through development zone 15. A toner pile height control means 25, shown in the form of a wiping blade, is disposed in spaced relationship with respect to the toner support member 21 such that the toner blanket has a thickness approximately equal to the distance from the toner support member 21 to the imaging member 11. This insures that the toner particles 17 will be brought into the sphere of influence of the nonuniform charge pattern without excessive contact with the imaging member 11 in nonimage areas where background can be created. Associated with the toner support member 21 is a vibration means 27 which imparts vibratory motion to the toner particles in a direction perpendicular to the surface of the image member 11. A source of toner 28 is provided in order to supply toner particles 17 to the toner transport means 19. The toner particles 17 will build up behind the toner pile height control means 25 and be leveled out thereby. Also provided is a housing 30 to catch the toner as it is dispensed from the toner transport member 21. The toner will thus fall by gravity into the sump of the housing 30 and from there it may be either reused or discarded. It is to be understood that the housing 30 may incorporate a device for returning the toner to the area of the toner support member 21 behind the toner pile height control means 25. Housing 30 includes a means 31, shown as a drawer, for removing toner particles 17 from the development means 13.

Adjacent to the development station C is a vacuum station 29 which exerts a very slight force sufficient only to remove toner particles from background areas. The vacuuming system causes a gentle movement of air in the direction shown by the arrows. A means, not shown, may be employed for transporting toner particles removed in this manner to a storage means or back into housing 30.

Transfer station D is shown generally wherein a corona generating device 39 is utilized to charge the toner particles 17 disposed in image configuration on the imaging member 11. Corona generating device 41 charges a substrate, such as plain paper, to the opposite sign and thereby transfers the toner particles 17 in image configuration from the imaging member 11 to the paper, which takes the path shown by the arrow in FIG. 1.

The paper bearing the toner image is then moved to a fixing device (not shown) wherein the toner particles are permanently affixed to the paper by suitable techniques known in the art such as, fusing, solvent fixing and the like.

The imaging member 11 continues in the direction shown to cleaning station E wherein a brush member 43 is depicted for removing any toner remaining on the imaging member prior to the imaging member being used once again in a subsequent cycle of the device.

FIG. 2 represents another embodiment of a development means 13 in accordance with this invention. As depicted herein the toner transport means 19 includes a toner support member 21 in the form of an inclined plane wherein toner particles 17 take the form of a toner blanket downstream of the toner pile height control means 25. The toner particles 17 proceed in this fashion to development zone 15 because the incline of the toner support member 21 and the vibration imparted to the toner support member 21 by the vibration means 27. The vibration means 27, as shown in the drawing, is in a direction such that it has a vibrational force vector both perpendicular to the toner support member and along the path of the toner support member. Thus, the toner particles are aided along the toner support member 21 to the development zone 15. Within the development zone 15, the toner support member 21 is concentric with the imaging member 11. The vibration member 27 can be varied with respect to both amplitude and frequency of the vibrations imparted to the imaging member 21 to maintain the toner blanket in a loosely packed condition and also to cause the blanket to move through the development zone 15 at the same rate that the imaging member 11 turns through the development zone 15. This action insures that the forces imposed on the imaging member 11 are substantially less than the forces causing the attraction of the polar or polarizable toner particles.

Figure 3:
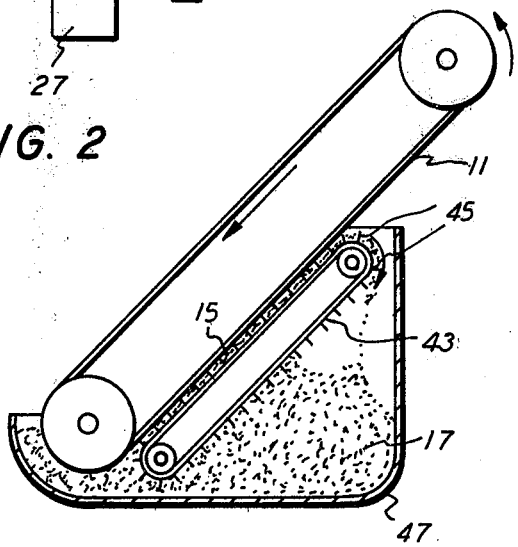

FIG. 3 represents still another embodiment in accordance with the invention wherein once again the imaging member 11 is in the form of a continuous belt as in FIG. 1 except here it is inclined with respect to the horizontal. The development zone 15 is shown as the area between the paddle conveyor 43 and the imaging member 11 wherein the paddle conveyor 43 is moved through the development zone 15 at the same rate of motion as that of the imaging member 11. The paddles 45 of the paddle conveyor 43 serve as the toner pile height control means regulating the toner blanket to a thickness such that the toner will come under the influence of the nonuniform charge pattern present on the imaging member 11. The paddle conveyor 43 picks up the toner particle 17 from the housing 47 and conveys the toner through the development zone 15. The remaining stations around the imaging members of both FIGS. 3 and 4 have not been depicted in the drawings, however, one skilled in the art would have no difficulty in utilizing the devices as shown herein in a suitable position in an electrostatographic device such as that shown schematically in FIG. 1.

It is believed that the foregoing description is sufficient for purposes of the present to illustrate the general operation of an electrophotographic printing machine incorporating the features of the present invention.

While this invention has been described herein in considerable detail, it is to be understood that various modifications will become apparent to those skilled in the art. Accordingly, it is intended to embrace all modifications within the spirit and scope of the appended claims.

What is claimed is:

1. A method of developing a latent electrostatic nonuniform charge pattern on an imaging member with polar or polarizable toner particles which comprises defining a development zone for the deposition of the toner particles on the imaging member in image configuration, moving the imaging member containing said nonuniform charge pattern through said development zone, moving a blanket of toner particles through said development zone in the same direction as that of the imaging member and at a speed substantially equal to that of the imaging member, the thickness of said blanket of toner being such that toner particles forming the toner blanket are captured by the nonuniform charge pattern.

2. The method of claim 1 wherein the blanket of toner particles is subjected to a vibratory motion.

3. The method of claim 2 wherein the force creating the vibratory motion has a vector at right angles to the direction of travel of the toner blanket.

4. The method of claim 2 wherein the force creating the vibratory motion has a vector at right angles to the direction of travel of the toner blanket and a vector parallel to the direction of travel of the toner blanket.

5. The method of claim 1 wherein the thickness of the blanket of toner is controlled by gravity.

6. The method of claim 1 wherein the thickness of the blanket of toner is controlled by a wiping action.

7. In an electrostatographic recording apparatus including an imaging member that moves through a plurality of processing stations said imaging member having thereon a nonuniform charge pattern in image configuration, the improvement comprising a development means, said development means together with said imaging member defining a development zone where polar or polarizable uncharged toner particles are deposited on said nonuniform charge pattern present on said imaging member, said development means including a toner transport means for moving said uncharged toner through said development zone at a rate substantially equal to the rate at which said imaging member moves through said plurality of stations.

8. The electrostatographic recording apparatus of claim 7 wherein said toner transport means includes a toner support member and a means for providing motion to said uncharged toner particles along said toner support member towards and through said development zone.

9. The apparatus of claim 8 wherein said toner support member has associated therewith a toner pile height control means.

10. The apparatus of claim 9 wherein the toner pile height control means is a blade member.

11. The apparatus of claim 8 wherein the toner support member is provided with a vibration means for imparting vibratory motion to said toner support member.

12. The apparatus of claim 11 wherein the plane of vibration of said vibration means provides a force component to said uncharged toner particles toward said development zone.

13. The apparatus of claim 7 wherein the toner support member is inclined with respect to the horizontal toward said development zone.

14. The electrostatographic apparatus of claim 7 wherein the toner transport means is a conveyor that moves at the same speed and in the same direction as said imaging member.

15. The apparatus of claim 14 wherein said transport means includes a means for imparting vibration to said conveyor belt.

16. The apparatus of claim 14 wherein the conveyor is a continuous belt.

17. The apparatus of claim 14 wherein the conveyor is a paddle conveyor.

* * * * *